US006257141B1

(12) United States Patent
Hashimoto et al.

(10) Patent No.: US 6,257,141 B1
(45) Date of Patent: Jul. 10, 2001

(54) PRINTING-PLATE MOUNTING-POSITION INSTRUCTION SYSTEM

(75) Inventors: Nobuyuki Hashimoto, Hachiouji; Chuuji Miyauchi, Higashiyamato, both of (JP)

(73) Assignee: Tokyo Kikai Seisakusho, Ltd., Tokyo (JP)

( * ) Notice: Subject to any disclaimer, the term of this patent is extended or adjusted under 35 U.S.C. 154(b) by 0 days.

(21) Appl. No.: 09/326,597

(22) Filed: Jun. 7, 1999

(30) Foreign Application Priority Data

Nov. 20, 1998 (JP) ..... 10-346672

(51) Int. Cl.[7] ..... B41L 47/14

(52) U.S. Cl. ..... 101/477; 101/485; 101/486; 101/DIG. 36; 33/621

(58) Field of Search ..... 101/477, 483, 101/484, 485, 486, 494, DIG. 36; 33/614, 617, 618, 619, 620, 621, 623

(56) References Cited

U.S. PATENT DOCUMENTS

| | | | | |
|---|---|---|---|---|
| 4,665,824 | * | 5/1987 | Greiner et al. | 101/492 |
| 4,903,596 | * | 2/1990 | Jeschke et al. | 101/148 |
| 5,014,618 | * | 5/1991 | Zingher et al. | 101/365 |
| 5,672,858 | * | 9/1997 | Li et al. | 235/462 |
| 5,673,320 | * | 9/1997 | Ray et al. | 380/25 |
| 6,101,945 | * | 8/2000 | Hara et al. | 101/486 |

FOREIGN PATENT DOCUMENTS

| | | |
|---|---|---|
| 62-121936 | 8/1987 | (JP) . |
| 5-169638 | 7/1993 | (JP) . |
| 6-23970 | 2/1994 | (JP) . |
| 9-300594 | 11/1997 | (JP) . |
| 10-52906 | 2/1998 | (JP) . |
| 10-128955 | 5/1998 | (JP) . |
| 10-202840 | 8/1998 | (JP) . |

* cited by examiner

*Primary Examiner*—John S. Hilten
*Assistant Examiner*—Leslie J. Grohusky
(74) *Attorney, Agent, or Firm*—Armstrong, Westerman, Hattori, McLeland & Naughton, LLP

(57) ABSTRACT

A printing-plate mounting-position instruction system instructs a worker where to mount a plurality of printing plates in a rotary printing press. The system includes a controller, a reader, a judging device, and a display device. The controller creates assignment information for assigning printing plates to mounting positions on each of plate cylinders used in each of printing units on the basis of production instruction information. The reader reads a mark on a printing plate for printing-surface information. The judging device is connected to the controller and the reader and collates the assignment information received from the controller and the printing-surface information received from the reader, thereby judging the location where the printing plate is to be mounted. The display device displays the result of the judgment.

22 Claims, 2 Drawing Sheets

PRINTING-PLATE MOUNTING-POSITION INSTRUCTION SYSTEM

BACKGROUND OF THE INVENTION

1. Field of the Invention

The present invention relates to a printing-plate mounting-position instruction system for instructing a user where to mount a plurality of printing plates in a rotary printing press that produces printed matter by the steps of, for example, superposing printed paper webs collected from a plurality of printing units; cutting the superposed, printed paper webs; and folding the resultant superposed, printed cut sheets.

2. Description of the Related Art

A rotary newspaper-printing press is one type of a rotary printing press that produces printed matter by the steps of, for example, superposing printed paper webs collected from a plurality of printing units; cutting the superposed, printed paper webs; and folding the resultant superposed, printed cut sheets.

One set of rotary newspaper-printing press includes 3 to 10 paper web supply units, at least the same number of printing units, and one folding unit. This rotary newspaper-printing press set produces copies of newspapers by the steps of, for example, printing each of paper webs supplied from the paper web supply units in a single color or a plurality of colors; superposing printed paper webs; cutting the superposed, printed paper webs; and folding the resultant superposed, printed cut sheets.

In large-scale newspaper printing facilities, a plurality of sets of newspaper-printing presses are concurrently operated to print newspapers. Up to 16 printing plates, each of which can print a broad-type page, can be mounted on one printing unit.

Accordingly, printing of newspaper involves usage of a large number of printing plates, which, needless to say, must be mounted at expected positions.

The total number of pages or the page(s) to be printed in a plurality of colors varies depending on the type of newspaper or the date of issue. Printing units to be used vary accordingly. As a result, the locations where printing plates are to be mounted in each printing unit are not fixed.

Further, in newspaper printing, news varies with time and the contents of pages depend on the region of distribution, and printing plates to be mounted vary accordingly.

Mounting of plating plates imposes a heavy burden on a worker. In some cases, a worker may mount a printing plate at a wrong position, resulting in a large amount of paper being wasted.

Various kinds of systems for preventing such a mistake in mounting printing plates are proposed in, for example, Japanese Utility Model Application Laid-Open (kokai) No. 62-121936 and Japanese Patent Application Laid-Open (kokai) Nos. 5-169638, 6-23970, 9-300594, 10-52906, 10-128955, and 10-202840.

According to Japanese Utility Model Application Laid-Open No. 62-121936, a printing system includes a plurality of printing units and one folding unit. Each of the printing units include a plate cylinder on which a plurality of printing plates is mounted in a predetermined order. The folding unit is adapted to cut printed paper webs collected from the printing units and to fold the resultant printed cut sheets. The location where a printing plate is to be mounted on a plate cylinder of a printing unit selected for a certain printing job is determined on the basis of printing-unit selection information. The determined printing-plate mounting position is displayed in a digital form.

According to Japanese Patent Application Laid-Open (kokai) No. 5-169638, a printing plate bears a printing-plate identification mark containing printing-plate position information at an end edge portion, which is not involved in printing. The printing plate is mounted on a plate cylinder such that the printing-plate identification mark is visible from the outside. The mounted printing plate is irradiated with a light beam that contains cylinder position information regarding the plate-cylinder position, in order to read the printing-plate identification mark. The printing-plate position information is obtained from the printing-plate identification mark, while the cylinder position information is obtained from the light beam. Subsequently, the printing-plate position information is collated with the cylinder position information, thereby enabling automatic judgment of whether the printing plate is mounted at an expected position on the plate cylinder.

According to Japanese Patent Application Laid-Open (kokai) No. 6-23970, in a rotary newspaper-printing press, characters, marks, or figures are sensed from a traveling printed paper web, and the sensed characters, marks, or figures are processed for identification of printing information. The identified printing information is compared with that received from a higher-order controller. The result is displayed along with a warning if needed.

According to Japanese Patent Application Laid-Open (kokai) No. 9-300594, printing-plate mounting regions on a plate cylinder each bear a cylinder position identification mark containing cylinder position information, or a printing-plate identification mark containing printing-plate position information. Printing plates mounted in the respective printing-plate mounting regions each bear the printing-plate identification mark containing printing-plate position information, or the cylinder position identification mark containing cylinder position information. The cylinder position identification mark and the printing-plate identification mark are read so as to obtain the cylinder position information and the printing-plate position information, respectively. The read cylinder position information and printing-plate position information are input to a judging device, in which the cylinder position information and the printing-plate position information are collated with preset cylinder position information and preset printing-plate position information which are previously fetched in the judging device, thereby enabling automatic judgment of whether the printing plates are mounted at expected positions.

Japanese Patent Application Laid-Open (Kokai) No. 10-52906 discloses a printing-plate mounting-position marking printer and a method for mounting a printing plate onto a plate cylinder on the basis of marking printed by the printer. Specifically, a printing plate is marked with a cylinder position identification mark that contains mounting-cylinder position information. The cylinder position identification mark is read so as to obtain the mounting-cylinder position information. The printing-plate mounting-position marking printer prints the read mounting-cylinder position information in a printing area on the printing plate in a hydrophilic ink, so that the printed information becomes visible to a worker.

Japanese Patent Application Laid-Open (kokai) No. 10-128955 discloses a printing-plate mounting-position marking printer and a method for mounting a printing plate, which printer and method are substantially identical with those disclosed in Japanese Patent Application Laid-Open (kokai) No. 10-52906, except that the mounting-cylinder position information is printed on the back side of a printing plate and that ink is not particularly limited to a hydrophilic ink.

Japanese Patent Application Laid-Open (kokai) No. 10-202840 discloses a printing-plate mounting-position checking apparatus. The apparatus has a function of visibly printing mounting-cylinder position information on a printing plate in such an ink that does not affect printing, on the basis of a cylinder position identification mark which contains mounting-cylinder position information and which is stored in a cylinder position identification mark memory. The apparatus further provide a collation function for the printing plate that is attached to the plate cylinder after visual confirmation of the mounting-cylinder position information printed on the printing plate. That is, the apparatus reads the mounting-cylinder position information marked on the printing plate which a worker has mounted onto the plate cylinder, through identification by the marked information, and collates the read mounting-cylinder position information with that of the cylinder position identification mark stored in the memory.

Japanese Patent Application Laid-Open (kokai) No. 10-202840 further discloses a printing-plate mounting-position checking apparatus and a method for mounting a printing plate onto a plate cylinder according to mounting-cylinder position information marked on the printing plate. The apparatus has a function of reading a cylinder position identification mark provided on a printing plate for mounting-cylinder position information and visibly printing the read mounting-cylinder position information on the printing plate in such an ink that does not affect printing. The apparatus further provide a collation function for the printing plate that is attached to the plate cylinder after visual confirmation of the mounting-cylinder position information printed on the printing plate. That is, the apparatus reads the mounting-cylinder position information marked on the printing plate which a worker has mounted onto the plate cylinder, through identification by the marked information, and collates the read mounting-cylinder position information with that contained in the previously read cylinder position identification mark.

The above-described techniques involve the following problems.

According to Japanese Utility Model Application Laid-Open No. 62-121936, printing plates are theoretically assigned to mounting positions on a plate cylinder of each of printing units selected for a certain printing job, and the assignment is displayed in digital form. However, individual printing plates are not marked with information regarding locations where they are to be mounted, or the locations where individual printing plates are to be mounted are not instructed.

In the end, a worker must check the contents of a printing plate in order to determine where the printing plate is to be mounted; specifically, a mounting position on a specific plate cylinder of a specific printing unit.

Thus, a mental burden imposed on a worker during mounting of printing plates cannot be lessened. Further, it becomes impossible to reliably prevent an incident in which the worker mistakenly mounts a printing plate at a wrong position.

According to Japanese Patent Application Laid-Open (kokai) No. 5-169638, printing-plate position information is read from a printing-plate identification mark provided at a non-printing portion of a printing plate mounted on a plate cylinder. The read printing-plate position information is collated with cylinder position information obtained from a beam which is radiated onto each of printing-plate mounting positions, thereby enabling judgment of whether the printing plate is mounted properly. Thus, when a printing plate is to be mounted, a worker must check the contents of the printing plate in order to determine where the printing plate is to be mounted; specifically, a mounting position on a specific plate cylinder of a specific printing unit.

Thus, a mental burden imposed on a worker during mounting of printing plates cannot be lessened. Further, it becomes impossible to reliably prevent an incident in which the worker mistakenly mounts a printing plate at a wrong position.

Whether a printing plate is mounted at an expected position is checked as described above. However, when, due to a certain reason or accident, a printing unit to be used is changed to any other printing unit after a printing-plate identification mark is marked on a printing plate with a resultant change in the order of superposing printed paper webs collected from printing units, the printing-plate position information read from the printing-plate identification mark on the printing plate becomes inconsistent with the change of printing units. As a result, it becomes impossible to judge whether the printing plate is mounted at an expected position.

According to Japanese Patent Application Laid-Open (kokai) No. 6-23970, a predetermined printed image read from a traveling printed paper web is compared with printing information contained in a higher-order controller, thereby enabling judgment of whether printing is performed at a predetermined position. However, when a printing plate is to be mounted, a worker must check the contents of the printing plate in order to determine where the printing plate is to be mounted; specifically, a mounting position on a specific plate cylinder of a specific printing unit.

Thus, a mental burden imposed on a worker during mounting of printing plates cannot be lessened. Further, it becomes impossible to reliably prevent an incident in which the worker mistakenly mounts a printing plate at a wrong position.

Further, since whether a printed image is located at an expected position is checked after the start of printing, mounting of a printing plate at a wrong position results in a large amount of paper being wasted.

According to Japanese Patent Application Laid-Open (kokai) No. 9-300594, printing-plate mounting regions on a plate cylinder each bear an identification mark, and printing plates mounted in the respective printing-plate mounting regions each bear an identification mark. The identification marks are read so as to obtain cylinder position information or printing-plate position information. Based on the read information, judgment is made as to whether each of the printing plates is mounted at an expected position.

Thus, a mental burden imposed on a worker during mounting of printing plates cannot be lessened. Further, it becomes impossible to reliably prevent an incident in which the worker mistakenly mounts a printing plate at a wrong position.

Whether a printing plate is mounted at an expected position is checked as described above. However, when, due to a certain reason or accident, a printing unit to be used is changed to any other printing unit after a printing-plate identification mark is marked on a printing plate with a resultant change in the order of superposing printed paper webs collected from printing units, the cylinder position information or printing-plate position information contained in the identification mark marked on a printing plate becomes inconsistent with that contained in an identification mark associated with the printing unit where the printing plate is actually mounted. As a result, it becomes impossible to judge whether the printing plate is mounted at an expected position.

According to Japanese Patent Application Laid-Open (kokai) Nos. 10-52906 and 10-128955, a cylinder position identification mark marked on a printing plate is read. Subsequently, based on the mounting-cylinder position information contained in the read cylinder position identification mark, information representing the mounting position of the printing plate is printed on the printing plate so as to be visible to a worker. Referring to the printed information, the worker mounts the printing plate onto the relevant plate cylinder. Thus, a mental burden that would otherwise be imposed on the worker during mounting of printing plates can be lessened.

However, a printing mechanism, such as an ink-jet printing mechanism, for reading out an identification mark of a printing plate and for printing information regarding the mounting position of the printing plate is required, causing an increase in equipment cost, operating cost, and labor, such as maintenance of the printing mechanism.

Also, when, due to a certain reason or accident, a printing unit to be used is changed to any other printing unit after a cylinder position identification mark is marked on a printing plate with a resultant change in the order of superposing printed paper webs collected from printing units, the mounting-cylinder position information printed on the printing plate becomes inconsistent with the newly expected mounting position, potentially causing a worker to mount the printing plate at a wrong position.

As in the case of Japanese Patent Application Laid-Open (kokai) Nos. 10-52906 and 10-128955, according to Japanese Patent Application Laid-Open (kokai) No. 10-202840, information regarding where to mount a printing plate is printed on the printing plate so as to be visible to a worker. After the printing plate is mounted onto a plate cylinder according to the printed information, the printed information is read from the mounted printing plate and is collated with reference information for checking whether the mounted printing plate is an expected one.

Thus, a mental burden that would otherwise be imposed on the worker during mounting of printing plates can be lessened.

However, a printing mechanism, such as an ink-jet printing mechanism, for reading out an identification mark of a printing plate and for printing information regarding the mounting position of the printing plate is required, causing an increase in equipment cost, operating cost, and labor, such as maintenance of the printing mechanism.

Also, when, due to a certain reason or accident, a printing unit to be used is changed to any other printing unit after a cylinder position identification mark is marked on a printing plate, with a resultant change in the order of superposing printed paper webs collected from printing units, the mounting-cylinder position information printed on the printing plate becomes inconsistent with the newly expected mounting position, potentially causing the worker to mount the printing plate at a wrong position.

According to claim 1 of Japanese Patent Application Laid-Open (kokai) No. 10-202840, a printing plate is not marked with an identification mark, but is printed with information regarding the position where the printing plate is to be mounted. The publication does not definitely describe how the contents of a printing plate are recognized and associated with the information regarding the position where the printing plate is to be mounted. In any case, when a printing unit to be used is changed to any other printing unit after the printing plate is printed with the information regarding the position where the printing plate is to be mounted, the printed information becomes inconsistent with the newly expected mounting position, potentially causing a worker to mount the printing plate at a wrong position.

Further, even when a plate cylinder to which a printing plate has been mounted is checked as to whether the mounted printing plate is valid, on the basis of the mounting-position information printed on the printing plate, this check becomes invalid when the printing units are changed as mentioned above. This is because the printed information becomes inconsistent with the newly expected mounting position of the printing plate.

SUMMARY OF THE INVENTION

In view of the foregoing, an object of the present invention is to provide a printing-plate mounting-position instruction system capable of properly instructing a worker where to mount a printing plate during routine operation or even when printing units to be used are changed, thereby relieving a worker of a mental burden that would otherwise be imposed on the worker during mounting of printing plates, thereby enabling the worker to reliably mount printing plates at appropriate positions.

The present invention provides a printing-plate mounting-position instruction system in a rotary printing press that produces printed matter by the steps of superposing printed paper webs collected from a plurality of printing units; cutting the superposed, printed paper webs; and folding the resultant superposed, printed cut sheets. The system comprises a controller, a reader, a judging device, and a display device. The controller creates assignment information for assigning printing plates to printing-plate mounting positions on each of plate cylinders used in each of the printing units, on the basis of production instruction information including information regarding the number of total pages of printed matter, information regarding color-specified pages, and information regarding the printing units to be used. The reader reads printing-surface information marked on a printing plate in the form of, for example, a two-dimensional bar code. The printing-surface information is marked on the printing plate in association with formation of a printing image on the printing plate and includes information regarding a page number of the printing plate and printing-color information. The judging device is connected to the controller and the reader and collates the assignment information received from the controller and the printing-surface information received from the reader, thereby judging where to mount the printing plate marked with the received printing-surface information. The display device displays the result of judgment effected by the judging device.

A plurality of readers and a plurality of display devices may be provided such that the readers and the display devices are formed into pairs, each of which consists of one reader and one display device. The pairs are connected to the judging device. Alternatively, a plurality of readers, a plurality of display devices, and a plurality of judging devices may be provided such that the readers, the display devices, and the judging devices are formed into groups, each of which consists of one reader, one display device, and one judging device. The groups are associated with the controller.

A designation may be assigned to each of printing-plate mounting positions, and the display device may assume the form of a designation display device for displaying, in the form of the designation, the printing-plate mounting position determined by the judging device. Alternatively, the display device may assume the form of a light-emitting device corresponding to each of the printing-plate mounting positions or the form of combination of the designation display device and the light-emitting device.

The judging device, the display device, or the reader may be provided for each of the printing units. Alternatively, the judging devices, the display devices, or the readers may each be provided for a plurality of the printing units.

According to the printing-plate mounting-position instruction system of the present invention, the printing-surface information marked on a printing plate is collated with the assignment information created on the basis of the production instruction information which is valid at the time when the printing plate is to be mounted, thereby judging where to mount the printing plate. The result of the judgment is displayed. Thus, the system can properly instruct a worker where to mount the printing plate whenever the printing plate is to be mounted and even when a printing unit to be used is changed to any other printing unit for some reason.

Accordingly, a worker can be relieved from a mental burden that would otherwise be imposed on the worker during mounting of printing plates.

Further, since a printing plate can be reliably mounted at an expected position, waste of paper which would otherwise result from mounting of the printing plate at a wrong position can be prevented.

BRIEF DESCRIPTION OF THE DRAWINGS

Various other objects, features and many of the attendant advantages of the present invention will be readily appreciated as the same becomes better understood by reference to the following detailed description of the preferred embodiments when considered in connection with the accompanying drawings, in which.

DESCRIPTION OF THE PREFERRED EMBODIMENTS

Embodiments of the present invention will next be described in detail with reference to the drawings.

First, production instruction information A is prepared. The production instruction information A includes the title of printed matter (hereinafter referred to as a product) produced by a rotary printing press and the number of copies of printing as well as information regarding assignment of a plurality of printing plates P to appropriate positions for producing the product. The information includes at least information regarding the number of total pages of the product, information regarding color-specified pages indicative of the page(s) of the product to be printed in colors, and information regarding printing units to be used for production of the product.

A printing plate P is marked with printing-surface information B which makes one-to-one correspondence to a printing image to be printed by the printing plate P to thereby distinguish the printing image from any other printing image. The printing-surface information B indicates the specifications of the corresponding printing image and includes at least the title of the product, information regarding a page number indicative of the page of the product at which the printing image of the printing plate P appears, and information regarding printing colors indicative of colors to be used for printing the printing image.

During process work, the printing image is formed on the printing plate P, and a mark that contains the printing-surface information B is marked on, for example, an end bend portion Pa of the printing plate P used for mounting the printing plate P onto a plate cylinder.

The mark that contains the printing-surface information B assumes the form of, for example, a bar code. When a large amount of information is to be displayed within a small area, a two-dimensional bar code capable of retaining information in two directions is more effective than a unidirectional bar code that retains information only in a single direction.

A test has revealed that the printing-surface information B in the form of 10-digit alphanumeric characters indicative of the specifications of one page of newspaper can be readably represented by a Q code (a kind of two-dimensional bar code) in the form of a square measuring 2.0 mm×2.0 mm.

Figure 1:
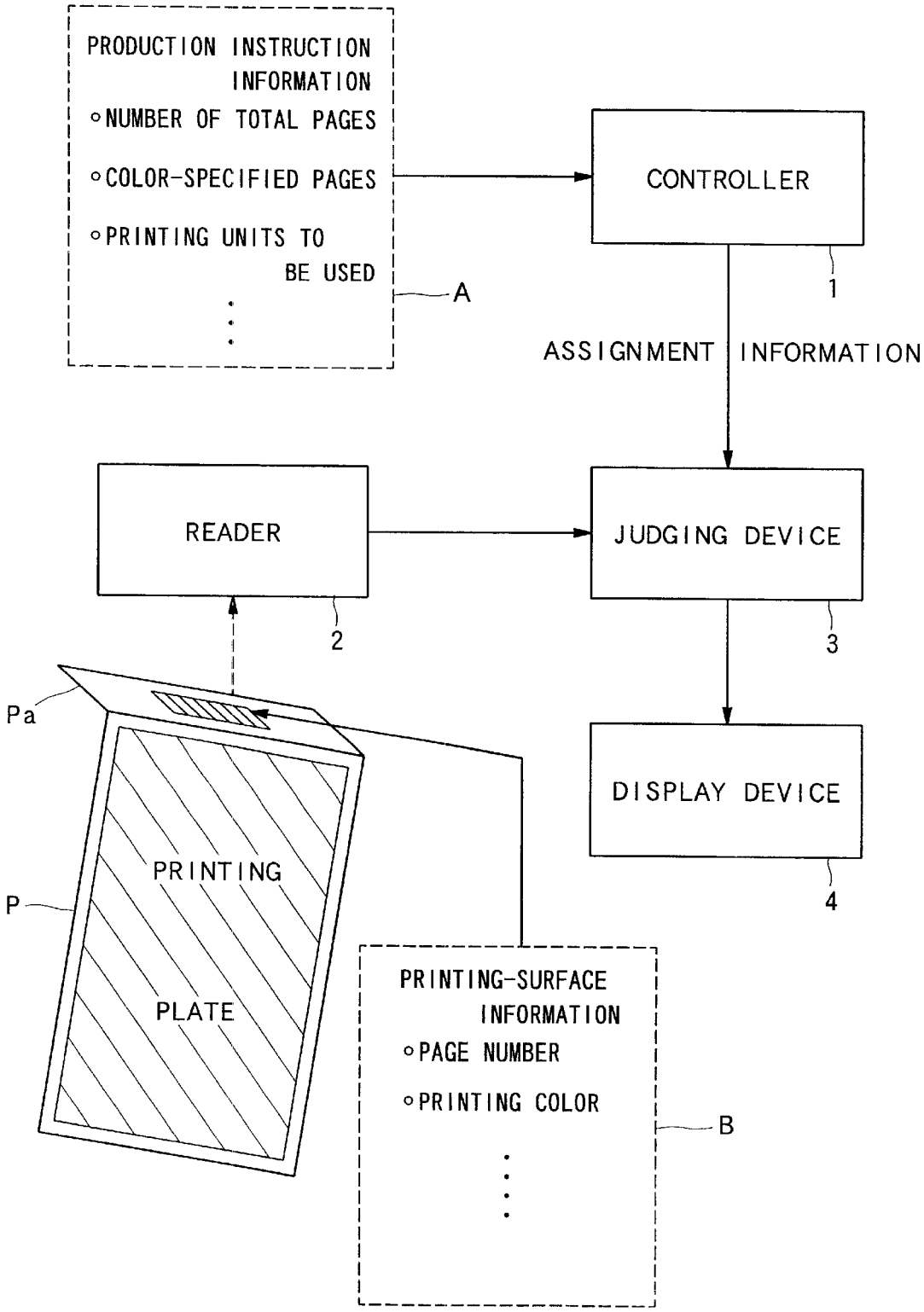
FIG. 1 is a block diagram showing the configuration of a printing-plate mounting-position instruction system according to a first embodiment of the present invention.

FIG. 1 shows a printing-plate mounting-position instruction system according to a first embodiment of the present invention. The system includes a controller 1, a reader 2, a judging device 3, and a display device 4. The controller 1 creates assignment information for assigning printing plates P to printing-plate mounting positions on each of plate cylinders used in each of printing units on the basis of the received production instruction information A. The reader 2 reads the mark on, for example, the end bend portion Pa for the printing-surface information B. The judging device 3 is connected to the controller 1 and the reader 2 and collates the assignment information received from the controller 1 and the printing-surface information B received from the reader 2, thereby judging the location where the printing plate P marked with the received printing-surface information B is to be mounted. The display device 4 displays the result of the judgment in such a manner that a worker can properly and at least visually recognize where the printing plate P is to be mounted; specifically, a mounting position on a specific plate cylinder of a specific printing unit.

Figure 2:
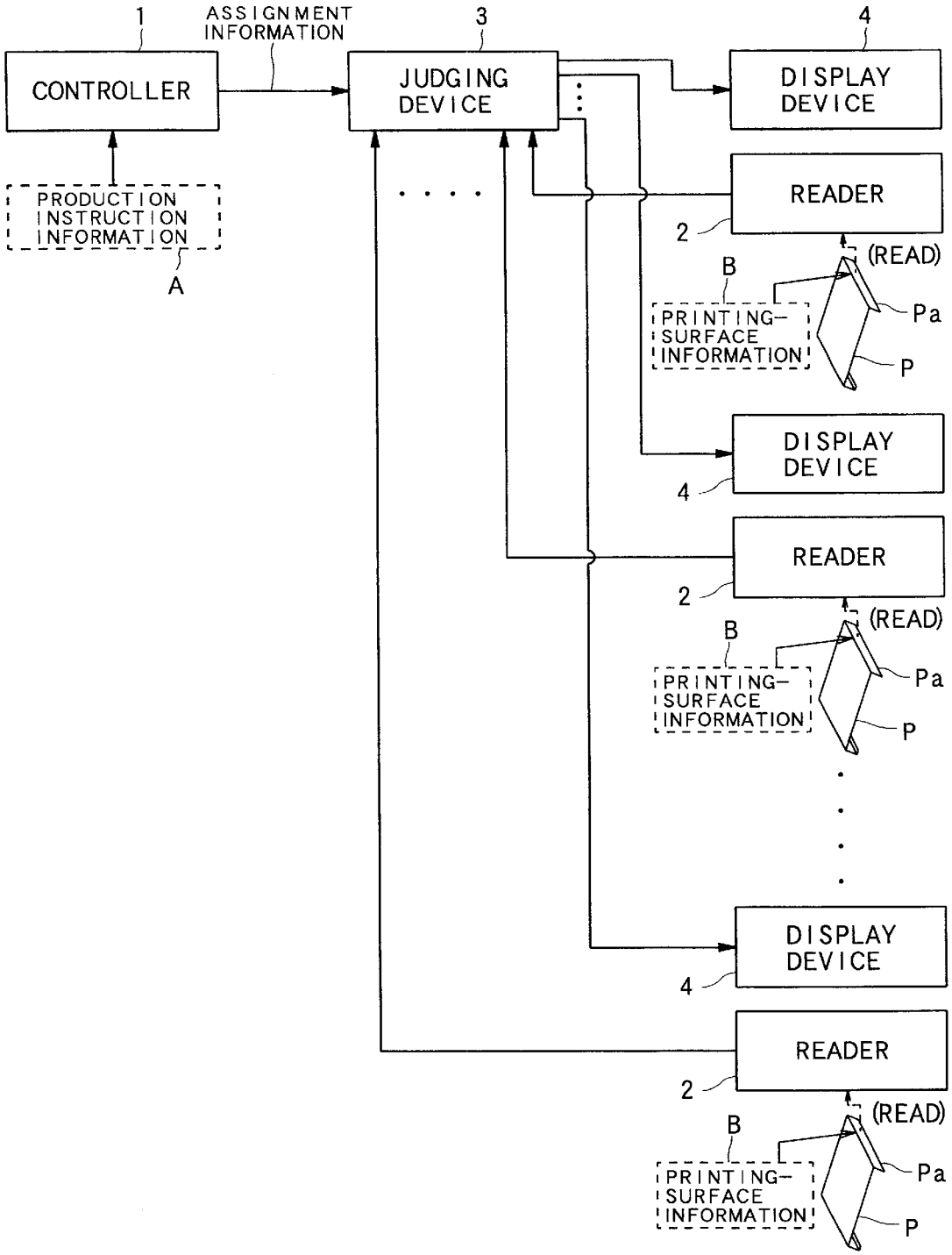
FIG. 2 is a block diagram showing the configuration of a printing-plate mounting-position instruction system according to a second embodiment of the present invention.

FIG. 2 shows a printing-plate mounting-position instruction system according to a second embodiment of the present invention. The second embodiment differs from the first embodiment in that a plurality of readers 2 and the same number of the display units 4 are each paired and connected to the judging device 3.

According to an unillustrated modified embodiment, a plurality of readers 2, the same number of the display units 4, and the same number of the judging devices 3 are each grouped and connected to the controller 1.

According to the second embodiment or the unillustrated modified embodiment, the reader 2 and the display device 4 can be provided for each of printing units or for each of plate cylinders. The system, therefore, can instruct a worker where the printing plate P is to be mounted, in such a manner that the worker can confirm the mounting position near the relevant printing unit or plate cylinder. Thus, the efficiency of check effected by the worker is improved.

The configuration of the printing-plate mounting-position instruction systems of the above embodiments will be further described. The controller 1 may also serve as a production controller for controlling production performed by a set of or sets of rotary printing presses. One set of rotary printing press includes a plurality of printing units, a plurality of paper web supply units, and a folding unit for superposing printed paper webs collected from the printing units, cutting the superposed, printed paper webs, and folding the resultant superposed, printed cut sheets.

The production instruction information A is input to the controller 1 by an appropriate entry method, such as manual entry or entry by means of a floppy disk. Receiving the production instruction information A or being informed of any modification of the production instruction information A, the controller 1 creates assignment information for assigning the printing plates P to printing-plate mounting positions on each of plate cylinders used in each of printing units on the basis of the received production instruction information A or informed modification.

The reader 2 is adapted to read a mark that contains the printing-surface information B, and employs a reading system compatible with a recording scheme of the mark. For example, the reader 2 assumes the form of a magnetic reader when the mark is of magnetic recording, or the form of an optical image reader when the mark is represented by a visible image, such as characters or symbols.

The judging device 3 is implemented by, for example, a CPU. The judging device 3 extracts at least information regarding a page number and information regarding printing colors from the printing-surface information B received from the reader 2. The information regarding a page number indicates a specific page of a product at which a printing image formed on the printing plate P appears. The information regarding printing colors specifies colors in which the printing image is printed. The judging device 3 collates the extracted information with the assignment information received from the controller 1, thereby judging where the printing plate P is to be mounted; specifically, a mounting position on a specific plate cylinder of a specific printing unit.

The display device 4 can display characters and assumes the form of, for example, an LED dot-matrix display, a liquid crystal panel, or a CRT. The display device 4 displays, in a predetermined format, a mounting position assigned to the printing plate P whose printing-surface information B has been read through the reader 2. The display format includes symbols indicative of where the printing plate P is to be mounted; specifically, a symbol for specifying a printing unit, a symbol for specifying a plate cylinder used in the printing unit, and a symbol for specifying a mounting position on the plate cylinder.

The operation of the printing-plate mounting-position instruction system described above will next be described.

Before the production of a product is started, desired production instruction information A is input to the controller 1. On the basis of the production instruction information A, the controller 1 creates assignment information for assigning the printing plates P to printing-plate mounting positions on each of plate cylinders used in each of printing units.

For example, when newspaper of 32 board-type pages is to be produced by use of four printing units capable of printing on the opposite sides of printing paper of a double-size (a width across which four broad-type pages of newspaper can be arranged), printed paper webs are superposed and folded along the centerline thereof upstream of a former. Specifically, a paper web printed by a printing unit located on the front side of the former of a folding unit is superposed on that printed by a printing unit located on the back side of the former. Further, paper webs printed by the printing units located on the front side of the former are superposed such that a paper web printed by a printing unit located closer to the folding unit is located on the upper side. Paper webs printed by the printing units located on the back side of the former are superposed such that a paper web printed by a printing unit located closer to the folding unit is located on the lower side.

Accordingly, in the case of the printing unit located on the front side of the former and closest to the folding unit, the printing plates P are assigned to mounting positions on one plate cylinder such that page 1 and page 32 are arranged adjacent to each other and such that page 3 and page 30 are arranged adjacent to each other. Also, the printing plates P are assigned to mounting positions on the other plate cylinder such that the printing plate P for printing page 2 is assigned to the position for printing the back side of page 1; the printing plate P for printing page 31 is assigned to the position for printing the back side of the page 32; the printing plate P for printing page 4 is assigned to the position for printing the back side of page 3; and the printing plate P for printing page 29 is assigned to the position for printing the back side of page 30. Similarly, the printing plates P are assigned to mounting positions on plate cylinders of other printing units in such a manner as to be compatible with the order of superposition of printed webs.

When a product includes a page to be printed in colors, the printing plate P for printing the page is assigned to a printing unit capable of printing in specified colors. When printing in colors is limited to a certain printing unit, the printing plate P for printing any color-specified page is assigned to the printing unit. Since a printed paper web including a color-specified page and other printed paper webs must be superposed such that pages of the product are orderly arranged, assignment of the printing plates P to mounting positions differ from the above-described regular assignment.

Similarly, assignment of the printing plates P depends on the contents of the production instruction information A, such as the configuration of one set of rotary printing press or the number of total pages of a product.

The controller 1 creates assignment information regarding the printed plates P so as to produce a product according to the received production instruction information A.

The assignment information created by the controller 1 is input to the judging device 3 in response to an appropriate instruction signal.

During process work, a mark that contains the printing-surface information B indicative of the specifications of a printing image is marked on the printing plate P. The prepared printing plate P is conveyed to a predetermined location in a printing room.

The reader 2 is provided at the predetermined location in the printing room. A worker causes the reader 2 to read the printing-surface information B marked on the printing plate P to be mounted.

The reader 2 inputs the read printing-surface information B to the judging device 3.

The judging device 3 extracts from the printing-surface information B at least information regarding a page number of a printing image formed on the printing plate P and information regarding printing colors. When a rotary printing press in the printing room is producing several kinds of products, the judging device 3 further extracts product information. The judging device 3 collates the extracted information with the assignment information received from the controller 1, thereby judges where the printing plate P is to be mounted; specifically, a mounting position on a specific plate cylinder of a specific printing unit. The judging device 3 inputs a signal to the display device 4 so as to operate the display device 4 according to the result of the judgment.

The display device 4 displays the mounting position of the printing plate P assigned by the judging device 3 in the form of, for example, designation and so as to be visible to a worker. An example of such a designation is "P13-R-OF," which denotes "a printing-plate mounting position located on the operator side and on the frame side on a right-hand plate cylinder of printing unit No. 13."

In the case where the printing plates P are conveyed to positions located near printing units, at least the reader 2 and the display device 4 may be provided for each of the printing units or for each of the plate cylinders. The reader 2 is adapted to read the printing-surface information B from each of the printing plates P. The display device 4 is adapted to display the result of assignment of each of the printing plates P to a mounting position. The display device 4 may assumes the form of combination of a designation display device for displaying a designation indicative of a mounting position and a light-emitting device for visibly indicating the mounting position.

When the reader 2 is provided for each of plate cylinders, enabling a worker to check for a printing-plate mounting position by means of a light-emitting device, the display device 4 may simply assume the form of a light-emitting device provided at each of printing-plate mounting positions.

After causing the reader 2 to read the printing-surface information B from the printing plate P, a worker can mount the printing plate P at a position specified by the display device 4 and thus can be freed from a potential mistake of mounting the printing plate P at a wrong position.

When a printing unit to be used is changed to any other printing unit due to the occurrence of a problem in a rotary printing press after the printing plate P is formed, i.e., after the printing-surface information B is marked on the printing plate P, the production instruction information A contained in the controller 1 is modified, or new production instruction information A is input to the controller 1. The controller 1 creates new assignment information, which is then input to the judging device 3.

Accordingly, the mounting position for each of the printing plates P is determined and displayed on the base of the assignment information which is valid at the time when the printing plate P is about to be mounted. A worker, therefore, can properly mount the printing plate P by mounting at the displayed mounting position.

As described above, according to the present invention, the printing plate P can be mounted at an expected position. In order to ensure that the printing plate P is properly mounted, a known reader may be provided. In this case, the printing-surface information B is read from the mounted printing plate P and collated with the assignment information created by the controller 1.

An inspection device may be additionally provided for checking whether the mounted printing plate P is located at an expected position, thereby preventing a careless mistake potentially committed by a worker and an associated mistake of mounting the printing plate P at a wrong position.

Obviously, numerous modifications and variations of the present invention are possible in light of the above teachings. It is therefore to be understood that within the scope of the appended claims, the present invention may be practiced otherwise than as specifically described herein.

What is claimed is:

1. A printing-plate mounting-position instruction system in a rotary printing press that produces printed matter by the steps of:

superposing printed paper webs collected from a plurality of printing units;

cutting the superposed, printed paper webs; and folding the resultant superposed and printed cut sheets, said system comprising:

a controller for creating assignment information for assigning printing plates to printing-plate mounting positions on each of plate cylinders used in each of the printing units on the basis of production instruction information including information regarding the number of total pages of printed matter, information regarding color-specified pages, and information regarding the printing units to be used;

at least one printing plate having printing surface information marked thereon;

at least one reader for reading the printing-surface information, the printing-surface information being marked on the printing plate in association with formation of a printing image on the printing plate and including information regarding a page number of the printing plate and printing-color information;

at least one judging device connected to said controller and said reader and adapted to collate the assignment information received from said controller and the printing-surface information received from said reader, thereby judging where to mount the printing plate marked with the received printing-surface information; and at least one display device for displaying the result of judgment effected by said judging device.

2. A printing-plate mounting-position instruction system according to claim 1, wherein said at least one reader includes a plurality of readers and said at least one display device includes a plurality of display devices, said readers and said display devices are provided such that said readers and said display devices are formed into pairs, each of which consists of one said reader and one said display device, and such that the pairs are connected to said judging device.

3. A printing-plate mounting-position instruction system according to claim 2, wherein a designation is assigned to each of the printing-plate mounting positions, and each said display device assumes the form of a designation display device for displaying, in the form of the designation, the printing-plate mounting position determined by said at least one judging device.

4. A printing-plate mounting-position instruction system according to claim 2, wherein each said display device assumes the form of a light-emitting device corresponding to each of printing-plate mounting positions.

5. A printing-plate mounting-position instruction system according to claim 2, wherein a designation is assigned to each of the printing-plate mounting positions, and each said display device assumes the form of a combination of a designation display device for displaying, in the form of the designation, the printing-plate mounting positions determined by said at least one judging device and a light-emitting device corresponding to each of the printing-plate mounting positions.

6. A printing-plate mounting-position instruction system according to claim 2, wherein said plurality of display devices are each provided for a plurality of the printing units.

7. A printing-plate mounting-position instruction system according to claim 2, wherein said plurality of readers are each provided for a plurality of the printing units.

8. A printing-plate mounting-position instruction system according to claim 2, wherein the printing-surface information marked on said at least one of the printing plates is in the form of a two-dimensional bar code.

9. A printing-plate mounting-position instruction system according to claim 1, wherein said at least one reader includes a plurality of readers, said at least one judging devices includes a plurality of judging devices, and said least one display devices includes a plurality of said display devices, said readers, judging devices and display devices are provided such that said readers, and said display devices, and said judging devices are formed into groups, each of which consists of one said reader, one said display device, and one said judging device, and such the groups are associated with said controller.

10. A printing-plate mounting-position instruction system according to claim 9, wherein a designation is assigned to each of the printing-plate mounting positions, and each said display device assumes the form of a designation display device for displaying, in the form of the designation, the printing-plate mounting position determined by each said judging device.

11. A printing-plate mounting-position instruction system according to claim 9, wherein each said display device assumes the form of a light-emitting device corresponding to each of printing-plate mounting positions.

12. A printing-plate mounting-position instruction system according to claim 9, wherein a designation is assigned to each of the printing-plate mounting positions, and each said display device assumes the form of a combination of a designation display device for displaying, in the form of the designation, the printing-plate mounting positions determined by each said judging device and a light-emitting device corresponding to each of the printing-plate mounting positions.

13. A printing-plate mounting-position instruction system according to claim 9, wherein said plurality of display devices are each provided for a plurality of the printing units.

14. A printing-plate mounting-position instruction system according to claim 9, wherein said plurality of readers are each provided for a plurality of the printing units.

15. A printing-plate mounting-position instruction system according to claim 9, wherein the printing-surface information marked on said at least one of the printing plates is in the form of a two-dimensional bar code.

16. A printing-plate mounting-position instruction system according to claim 1, wherein a designation is assigned to each of the printing-plate mounting positions, and said at least one display device assumes the form of a designation display device for displaying, in the form of the designation, the printing-plate mounting position determined by said at least one judging device.

17. A printing-plate mounting-position instruction system according to claim 1, wherein said at least one display device assumes the form of a light-emitting device corresponding to each of printing-plate mounting positions.

18. A printing-plate mounting-position instruction system according to claim 1, wherein a designation is assigned to each of the printing-plate mounting positions, and said at least one display device assumes the form of a combination of a designation display device for displaying, in the form of the designation, the printing-plate mounting positions determined by said at least one judging device and a light-emitting device corresponding to each of the printing-plate mounting positions.

19. A printing-plate mounting-position instruction system according to claim 1, wherein said at least one reader is provided for each of the printing units.

20. A printing-plate mounting-position instruction system according to claim 1, wherein said at least one display device is provided for one of the printing units.

21. A printing-plate mounting-position instruction system according to claim 1, wherein the printing-surface information marked on said at least one of the printing plates is in the form of a two-dimensional bar code.

22. A printing-plate mounting-position instruction system according to claim 1, wherein said at least one reader is provided for one of the printing units.

* * * * *